US010049805B2

(12) United States Patent
Kobayashi

(10) Patent No.: US 10,049,805 B2
(45) Date of Patent: Aug. 14, 2018

(54) COIL DEVICE

(71) Applicant: TDK CORPORATION, Tokyo (JP)

(72) Inventor: Katsumi Kobayashi, Tokyo (JP)

(73) Assignee: TDK CORPORATION, Tokyo (JP)

( * ) Notice: Subject to any disclaimer, the term of this patent is extended or adjusted under 35 U.S.C. 154(b) by 0 days.

(21) Appl. No.: 15/447,975

(22) Filed: Mar. 2, 2017

(65) Prior Publication Data

US 2017/0263368 A1 Sep. 14, 2017

(30) Foreign Application Priority Data

Mar. 11, 2016 (JP) ..... 2016-048633

(51) Int. Cl.

| | |
|---|---|
| ***H01F 27/02*** | (2006.01) |
| ***H01F 27/28*** | (2006.01) |
| ***H01F 27/32*** | (2006.01) |
| ***H01F 5/02*** | (2006.01) |
| ***H01F 41/00*** | (2006.01) |
| ***H01Q 7/06*** | (2006.01) |

(52) U.S. Cl.

CPC ..... *H01F 27/022* (2013.01); *H01F 5/02* (2013.01); *H01F 27/2823* (2013.01); *H01F 27/325* (2013.01); *H01F 41/005* (2013.01); *H01Q 7/06* (2013.01)

(58) Field of Classification Search

None

See application file for complete search history.

(56) References Cited

U.S. PATENT DOCUMENTS

| | | | | |
|---|---|---|---|---|
| 3,883,834 A * | 5/1975 | Osteen | H01F 27/22 | 174/16.3 |
| 2015/0116171 A1* | 4/2015 | Koga | H01Q 7/08 | 343/788 |
| 2016/0093954 A1* | 3/2016 | Tabata | H01F 5/02 | 343/788 |

FOREIGN PATENT DOCUMENTS

JP 2014-175363 A 9/2014

OTHER PUBLICATIONS

English translation of JP2004125606.*

* cited by examiner

*Primary Examiner* — Ronald Hinson
(74) *Attorney, Agent, or Firm* — Oliff PLC

(57) ABSTRACT

A coil device has a potting resin 60. The potting resin 60 surrounds a bobbin 20 with a coil portion 12. The coil portion 12 is housed in a housing concave portion 42 of an outer case 40. Oblique plate legs 50 arranged obliquely are arranged between an outer peripheral wall 24 of the bobbin 20 and a bottom wall of the housing concave portion 42.

14 Claims, 8 Drawing Sheets

COIL DEVICE

BACKGROUND OF THE INVENTION

1. Field of the Invention

The present invention relates to a coil device as an antenna, for example.

2. Description of the Related Art

To protect a coil device used for antennas from impact including vibration, it is considered to house a bobbin with a coil portion in an outer case and seal around the coil device with a potting resin or so. The entire periphery of the bobbin is preferably sealed with resin in the outer case. Thus, as shown in Patent Document 1, a convex portion is arranged on an outer periphery of the bobbin to be sealed with resin and abuts against an inner wall of the outer case, and a space between the bobbin and the outer case is arranged so that a sealing resin reaches the space, for example.

Since the bobbin is constituted by a hard epoxy resin, however, the convex portion arranged on the outer periphery of the bobbin and the inner wall of the outer case are in contact, and impact resistance characteristics may be deteriorated. High-level impact resistance characteristics are required particularly for coil devices used in auto industry or so, and sufficient impact resistance characteristics are hard to be obtained by a conventional coil device structure.

Patent Document 1: JP 2014-175363A

SUMMARY OF THE INVENTION

The present invention has been achieved under such circumstances. It is an object of the invention to provide a coil device excellent in impact resistance characteristics.

To achieve the above object, the coil device according to the present invention is a coil device including:

a core member extending in a longitudinal direction;

a bobbin with a hollow space housing the core member;

a coil portion with a wire wound around an outer peripheral wall of the bobbin;

an outer case with a housing concave portion configured to house the bobbin housing the core member and having the coil portion on the outer peripheral wall; and a potting resin filled in the housing concave portion and surrounding the bobbin with the coil portion, wherein an easily deformable member is arrange between the outer peripheral wall of the bobbin and a bottom wall of the housing concave portion, and is capable of being deformed before deformations of the bobbin and the outer case when the outer case receives an impact.

In the coil device of the present invention, the bobbin touches the bottom hole of the outer case via the easily deformable member that is deformed more easily than the bobbin itself. When the outer case receives an impact, the easily deformable member is easily deformed elastically or plastically (may be broken), and the impact transmitted to the outer case is weakened and transmitted to the bobbin. The potting resin is filled in a space between the bobbin and the outer case. The potting resin has a sufficiently low longitudinal elasticity, and can thus effectively absorb the impact applied to the outer case in cooperation with the easily deformable member.

In the coil device of the present invention, impact resistance is thus improved compared with a conventional coil device where a convex portion (having approximately the same deformation strength as that of the bobbin) formed on the bobbin touches the bottom wall of the outer case. That is, it is possible to reduce an impact (by a drop test) applied to the core member arranged inside the bobbin. Thus, the present invention can effectively prevent a situation where the core member is broken.

The easily deformable member may be formed integrally with the bobbin or the outer case, and may be the easily deformable member may be an oblique plate leg or an oblique linear leg that is formed integrally with a part of the bobbin or the outer case, for example. Since the easily deformable member is formed integrally with the bobbin or the outer case, there is no need to separately prepare an easily deformable member, and this contributes to reduction of the number of components.

The outer peripheral wall constituting the hollow space may be provided with an opening portion communicating inside and outside of the bobbin. With the opening portion, the potting resin reaches inside of the bobbin via the opening portion, impact resistance characteristics are improved, and it is possible to further effectively prevent the breakage of the core member or so. The opening portion may be provided with the easily deformable member of the oblique plate leg, the oblique linear leg, or the like. When a plate member or a linear member is formed integrally from an opening edge of the opening portion and protrudes obliquely toward the bottom surface of the bobbin at a predetermined angle, the plate member or the linear member is easily deformed and can favorably function as the easily deformable member.

The bobbin may be provided with a pressing portion protruding from one of inner surfaces of the outer peripheral wall toward the hollow space, and the pressing portion may press the core member against the other inner surface of the outer peripheral wall. With this configuration, the core member is positioned against the bobbin with the coil portion, a positional displacement of the core member against the coil portion is prevented, and the characteristic deviation as antenna coil can be prevented.

The bobbin may be provided with a first pressing portion protruding from one of inner surfaces of the outer peripheral wall toward the hollow space, the bobbin may be provided with a second pressing portion protruding from the other inner surface of the outer peripheral wall toward the hollow space, and the first pressing portion and the second pressing portion may sandwich the core member so that the core member is positioned in the hollow space of the bobbin.

Even in this configuration, the core member is positioned against the bobbin with the coil portion, a positional displacement of the core member against the coil portion is prevented, and the characteristic deviation as coil can be prevented. In addition, in this configuration, a space between the core member and the bobbin is formed on both sides of the core member, the potting resin reaches the spaces, and impact resistance characteristics are further improved.

DESCRIPTION OF THE PREFERRED EMBODIMENTS

Figure 1A:
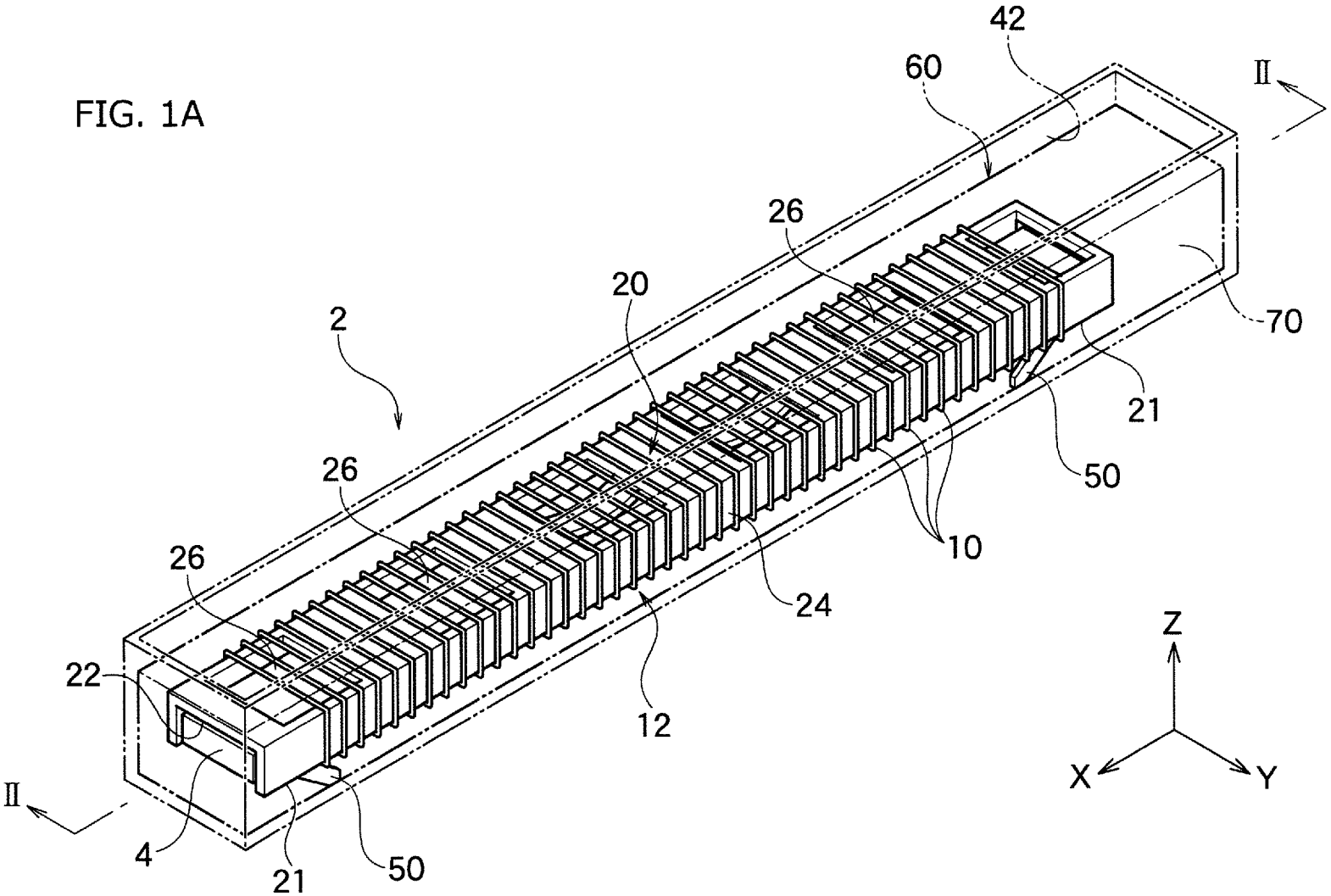
FIG. 1A is a partially transparent perspective view of a coil device according to an embodiment of the present invention.

Hereinafter, the present invention will be described based on embodiments shown in the figures.

First Embodiment

A coil device 2 according to First Embodiment of the present invention shown in FIG. 1A to FIG. 2A and FIG. 3A is used as an antenna device for automobiles mounted inside a doorknob or so, a coil for antenna included in a doorknob or so of housing like an apartment, or the like. The coil device 2 has a flat core member 4 that is long in the X-axis direction, is thin in the Z-axis direction, and is wide in the Y-axis direction. Incidentally, the X-axis, the Y-axis, and the Z-axis are vertical to each other in the figures.

The core member 4 has any size, and has a length in X-axis direction of 30 to 120 mm, a width in the Y-axis direction of 5 to 20 mm, and a thickness in the Z-axis direction of 1 to 10 mm, for example. In the present embodiment, the core member 4 is constituted by the single core member extending in the X-axis direction, but may be constituted by a plurality of core members simply arranged and divided in the X-axis direction in the bobbin 20, or may be constituted by joining these core members using an adhesive.

For example, the core member 4 may be constituted by a magnetic body, such as ferrite, metal magnetic body, permalloy, and pressed powder, or by a nonmagnetic body, such as alumina and ceramic. The core member 4 is preferably constituted by a magnetic body material whose relative permeability $\mu$ is preferably 1000 or more, more preferably 3000 or more, and particularly preferably 5000 or more. The core member 4 normally has a longitudinal elasticity of 100000 to 160000 MPa.

The core member 4 is configured to be inserted into a hollow space 22 in the X-axis direction formed inside the bobbin 20. The hollow space 22 of the bobbin 20 has a shape surrounding the core member 4, and as shown in FIG. 1B, L1/L0 is determined to be 0.6 to 1.3, where L1 is a length in the X-axis direction of the bobbin 20, and L0 is an axial length of the core member 4. That is, the core member 4 may protrude from the X-axis direction end of bobbin 20, or may be housed completely in the bobbin 20. Preferably, most of the core member 4 is configured to be housed in the hollow space 22 of the bobbin 20, and at least the core member 4 is configured to be positioned in the bobbin 20 where a coil portion 12 wound by a wire 10 is formed around the outer peripheral portion of the bobbin 20.

The single (or multiple) wire 10 is spirally wound around the outer peripheral wall 24 of the bobbin 20 in the X-axis direction so as to form the coil portion 12. The wire 10 may be any wire, such as resin coated wire and twisted wire. The wire 10 has any diameter, but preferably has 50 to 500 μm.

Figure 1B:
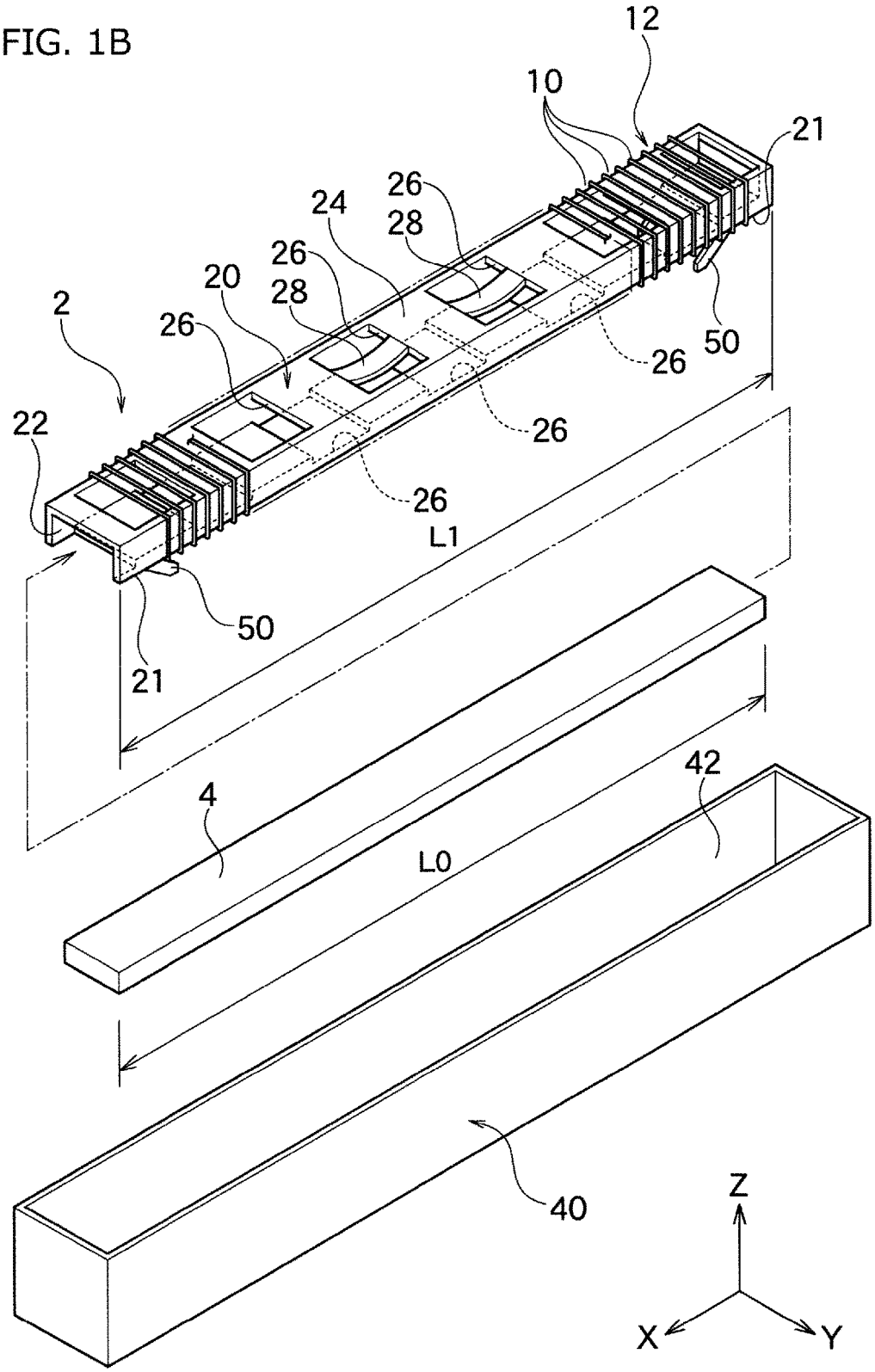
FIG. 1B is a disassembled perspective view of the coil device shown in FIG. 1A.

Both ends of the wire 10 forming the coil portion 12 are connected to various kinds of electronic components arranged in a component case housed in an electronic component housing portion 70 shown in FIG. 1A. The various kinds of electronic components include a resistor, a capacitor, and the like, needed as antenna devices. The electronic component housing portion 70 is formed at one of end positions in the X-axis direction of the bobbin 20 in a housing concave portion 42 of an outer case 40. The housing portion 70 has any length in the X-axis direction, but has about 1/10 to 1/2 of the length L1 in the X-axis direction of the bobbin 20 (see FIG. 1B).

As shown in FIG. 1B, opening portions 26 communicating inside and outside of the bobbin 20 are alternately formed along the X-axis direction on top and bottom surfaces in the Z-axis direction of the outer peripheral wall 24 of the bobbin 20. In the present embodiment, a two or more even number of the opening portions 26 is formed on the top surface of the outer peripheral wall 24 of the bobbin 20 at predetermined intervals in the X-axis direction, and an odd number of the opening portions 26 is formed on the bottom surface to be positioned between the respective opening portions 26 on the top surface. Incidentally, an odd number of the opening portions 26 may be formed on the top surface of the outer peripheral wall 24, and an even number of the opening portions 26 may be formed on the bottom surface.

Figure 2A:
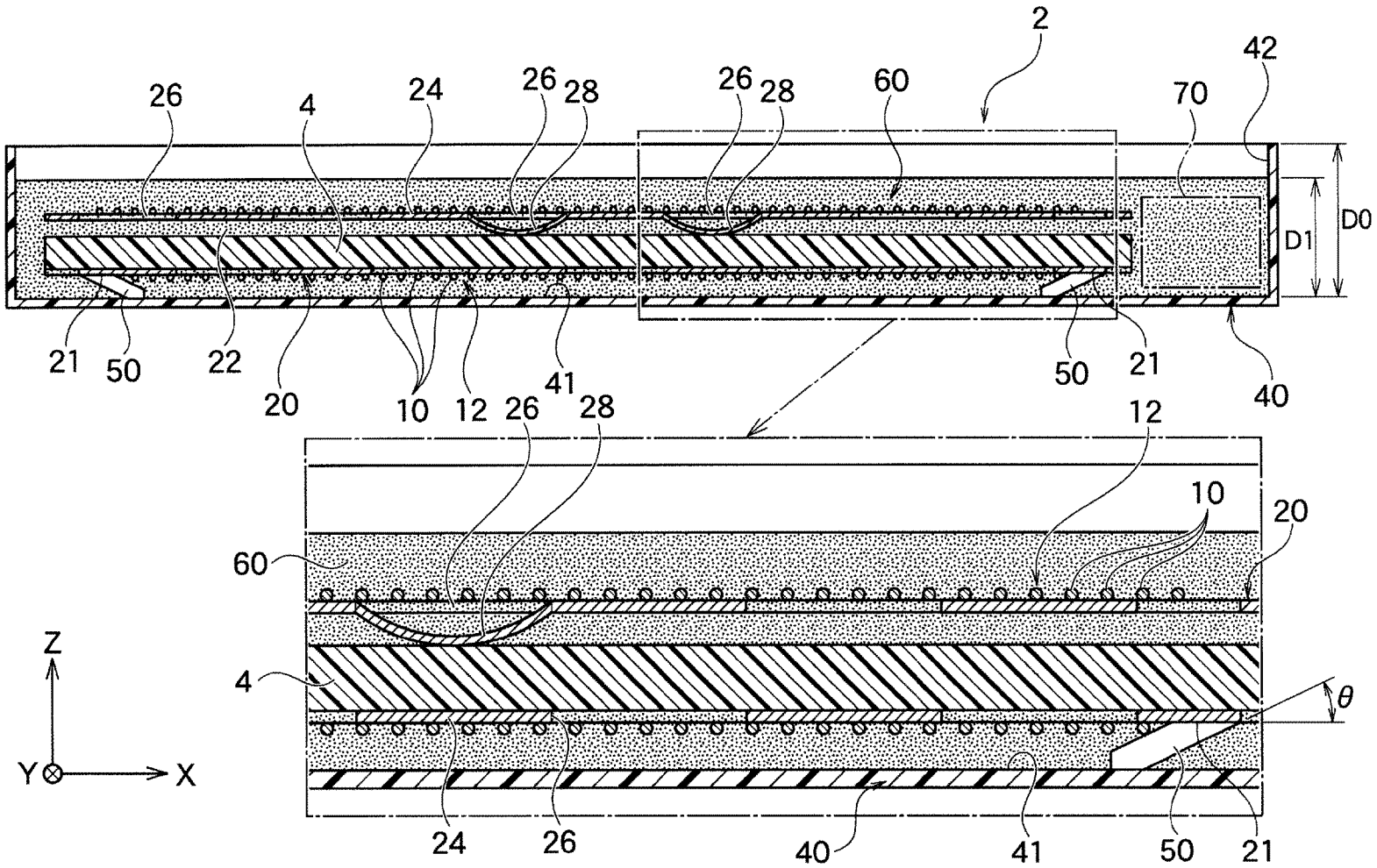
FIG. 2A is a cross sectional view along the II-II line of the coil device shown in FIG. 1A.

In the present embodiment, as shown in FIG. 1B and FIG. 2A, pressing pieces (pressing portions) 28 protruding from an inner surface of the outer peripheral wall 24 toward the hollow space 22 are formed integrally with the outer peripheral wall 24 in a plurality of the opening portions 26 positioned at an approximately middle part in the X-axis direction out of the opening portions 26 formed on the top surface of the outer peripheral wall 24. In the present embodiment, the pressing piece 28 is constituted by an arc piece connecting opening edges in the X-axis direction of the opening portion 26 in a downward convex shape at the middle part in the Y-axis direction of the opening portion 26. The pressing piece 28 has a width in the Y-axis direction that is smaller than a width in the Y-axis direction of the opening portion 26. Both sides of the pressing piece 28 do not shut the opening portion 26.

Incidentally, the pressing piece 28 may have a width in the Y-axis direction equal to a width in the Y-axis direction of the opening portion 26. Even in this case, the pressing piece 28 protrudes downward in the Z-axis direction from the inner surface of the outer peripheral wall 24, and slits are formed on both sides in the Y-axis direction of the pressing piece 28. The slits function as openings for communicating inside and outside of the outer peripheral wall 24, but the pressing pieces 28 do not need to be formed by corresponding to the opening portions 26, and may be formed in a part of the outer peripheral wall 24 where no opening portion 26 is formed.

In the present embodiment, as shown in FIG. 2A, the pressing pieces 28 are formed only on the top surface in the Z-axis direction of the outer peripheral wall 24, and are in contact with the top surface in the Z-axis direction of the core member 4 by spring force. Thus, the bottom surface in the Z-axis direction of the core member 4 is pressed against a bottom inner surface of the outer peripheral wall 24 constituting the hollow space 22 of the bobbin 20. As a result, the core member 4 is prevented from moving inside the bobbin 20 in the X-axis direction (the same applies to the Y-axis direction and the Z-axis direction) before a potting resin 60 mentioned below is filled or even while the potting resin 60 is being filled in the outer case 40.

For example, the bobbin 20 is formed by injection molding, and is constituted by a synthetic resin of PBT, PET, nylon, LCP, PPS, phenol, or the like. The bobbin 20 has a longitudinal elasticity of 1000 to 20000 MPa.

The outer case 40 has the housing concave portion 42 configured to house the bobbin 20 housing the core member 4 and having the coil portion 12 around the outer peripheral wall 24. The top in the Z-axis direction of the housing concave portion 42 is open, and the housing concave portion 42 is large enough to house the bobbin 20 surrounded by the potting resin 60. That is, the housing concave portion 42 has a depth D0 in the Z-axis direction (see FIG. 2A) that is 1.3 times to 2 times larger than a height in the Z-axis direction of the bobbin 20. The potting resin 60 has a filling depth D1 that is 0.5 times to 1 time larger than the depth D0 in the Z-axis direction of the housing concave portion 42. The filling depth D1 of the potting resin 60 is preferably 1.1 times to 1.5 times larger than a height in the Z-axis direction of the bobbin 20.

For example, the outer case 40 is formed by injection molding, and is constituted by a synthetic resin of PBT, PET, nylon, LCP, PPS, phenol, or the like. The outer case 40 has a longitudinal elasticity of 8000 to 10000 MPa, which is the same as or different from a longitudinal elasticity of the bobbin 20.

The potting resin 60 filled in the housing concave portion 42 of the outer case 40 is composed of a silicone resin, a urethane resin, an epoxy resin, or the like, that is still soft after the filling, and preferably has a longitudinal elasticity of 0.1 to 100 MPa. The potting resin 60 is filled around a periphery of the bobbin 20 with the coil portion 12, and is also filled in a space between the bobbin 20 and the core member 4 and in a space between the bobbin 20 and the inner wall surface of the outer case 40. The potting resin 60 is injected from the upper opening of the housing concave portion 42 of the outer case 40.

In the present embodiment, a plurality of oblique plate legs (easily deformable members) 50 is formed integrally with the bobbin 20 at both ends in the X-axis direction of a bottom outer surface 21 of the bobbin 20. In the present embodiment, two oblique plate legs 50 are formed at a predetermined interval in the Y-axis direction on both ends of the bobbin 20 in the X-axis direction (four oblique plate legs 50 are formed in total). As shown in FIG. 2A, each of the oblique plate legs 50 is inclined toward the bottom outer surface 21 of the bobbin 20 at a predetermined angle θ.

The predetermined angle θ is preferably 60 to 30 degrees, and more preferably 45 to 20 degrees. When the predetermined angle θ is too large, the oblique plate legs 50 tend to become hard to be deformed particularly even if an impact in the Z-axis direction is applied to the outer case 40. When the predetermined angle θ is too small, a space between the bottom outer surface 21 of the bobbin 20 and a bottom inner surface 41 of the outer case 40 tends to become small.

The oblique plate legs 50 touch the bottom inner surface 41 of the outer case 40 in the outer case 40 before the potting resin 60 is injected or while the potting resin 60 is being injected, and leave a space between the bottom surface of the bobbin 20 and the bottom inner surface 41 of the outer case 40 so that the potting resin 60 reaches the space easily.

The oblique plate leg 50 has a plate surface that is a parallel plate to the X-axis and the Z-axis in the present embodiment, but has any plate surface and may have a plate surface crossing the bottom outer surface 21 of the bobbin 20 at a predetermined angle θ. The oblique plate leg 50 does not necessarily have a linear plate shape, and may have a plate shape of curved surface. The oblique plate leg 50 may be formed in the opening portion 26. When the plate leg 50 is formed integrally from the opening edge of the opening portion 26 and protrudes obliquely toward the bottom surface of the bobbin 20 at a predetermined angle θ, the plate leg 50 is easily deformed and can favorably function as the easily deformable member.

As shown in FIG. 2A, the oblique plate leg 50 is at least interpositioned between the bottom outer surface 21 of the bobbin 20 and the bottom inner surface 41 of the outer case 40, but may be additionally formed on a side surface of the bobbin 20 in the Y-axis. In this case, the bobbin 20 can be positioned not only in the Z-axis direction but in the Y-axis direction in the outer case 40, and it is thus expected to buffer not only an impact in the Z-axis direction applied to the bobbin 20 and the core member 4 but an impact in the Y-axis direction applied to the bobbin 20 and the core member 4. As shown in FIG. 2A, no oblique plate leg 50 is formed at the ends of the core member 4 in the X-axis direction, but the oblique plate leg 50 may be also formed at these ends.

In the illustrated example, the oblique plate legs 50 are inclined toward the middle part of the bobbin 20 in the X-axis direction at a predetermined angle θ, but in contrast, may be inclined toward outside of the bobbin 20 in the X-axis direction at a predetermined angle θ.

Figure 2B:
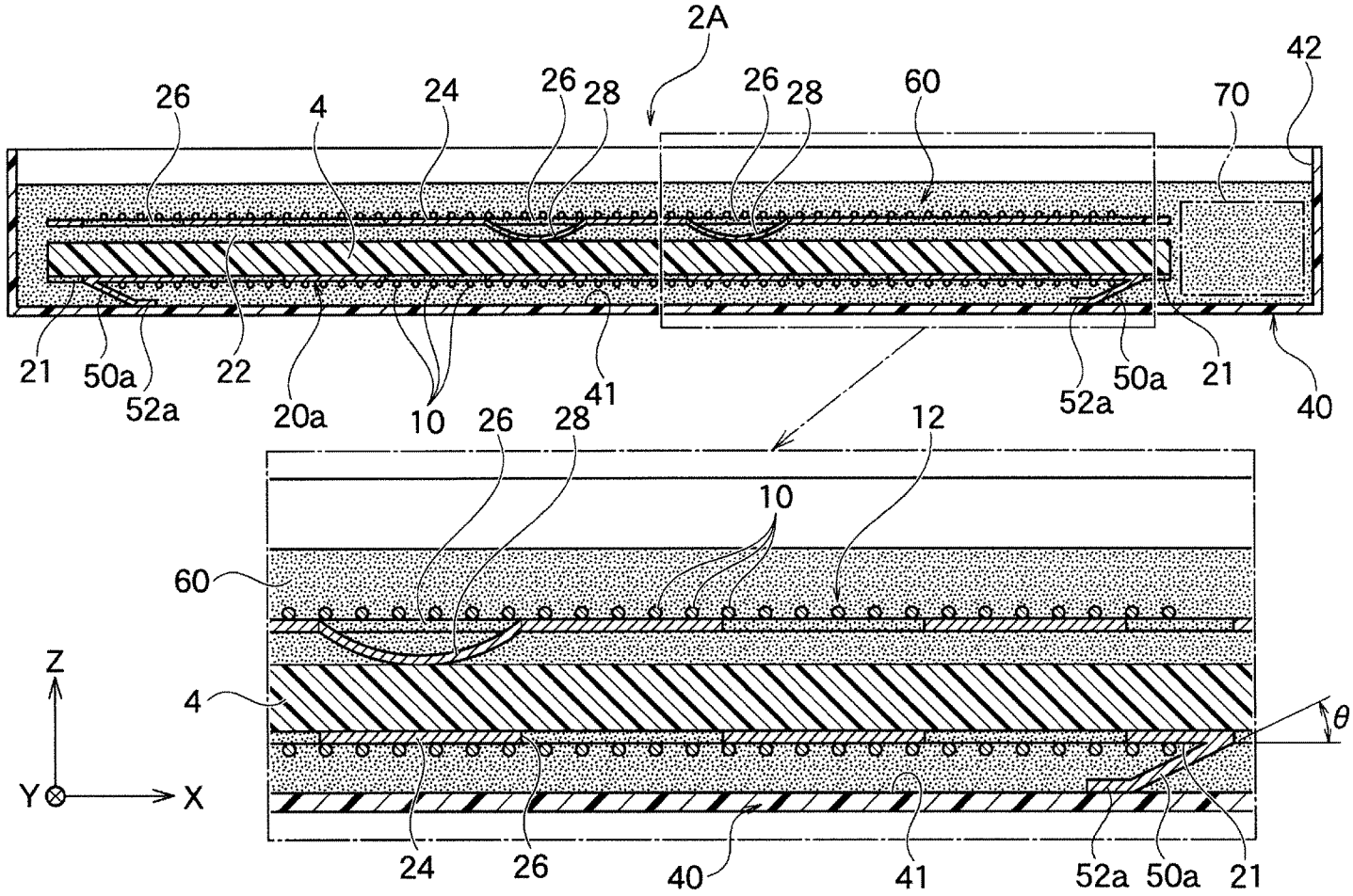
FIG. 2B is a cross sectional view showing a variation of the coil device shown in FIG. 2A.
Figure 2C:
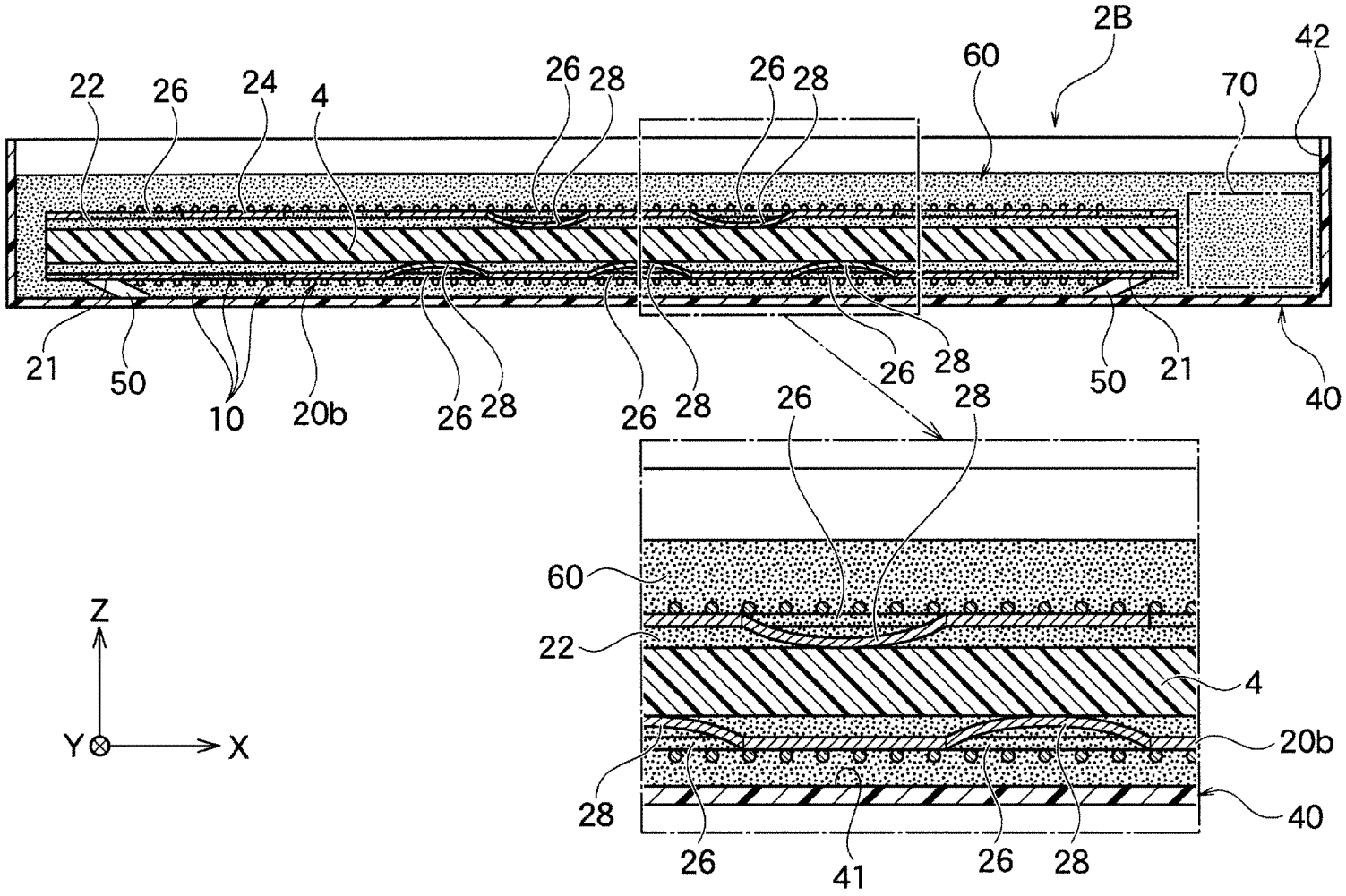
FIG. 2C is a cross sectional view showing another variation of the coil device shown in FIG. 2A.
Figure 2D:
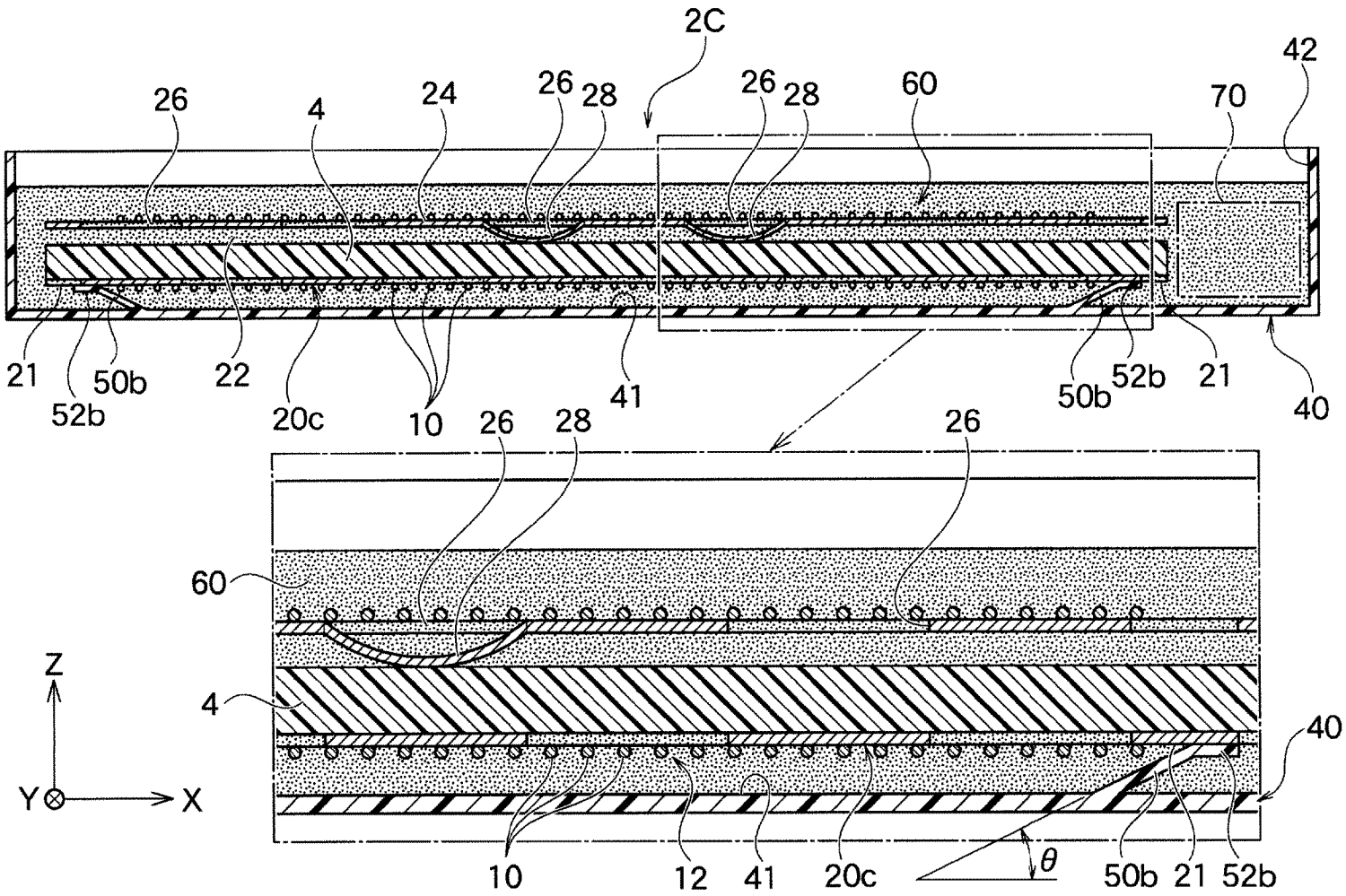
FIG. 2D is a cross sectional view showing another variation of the coil device shown in FIG. 2A.
Figure 2E:
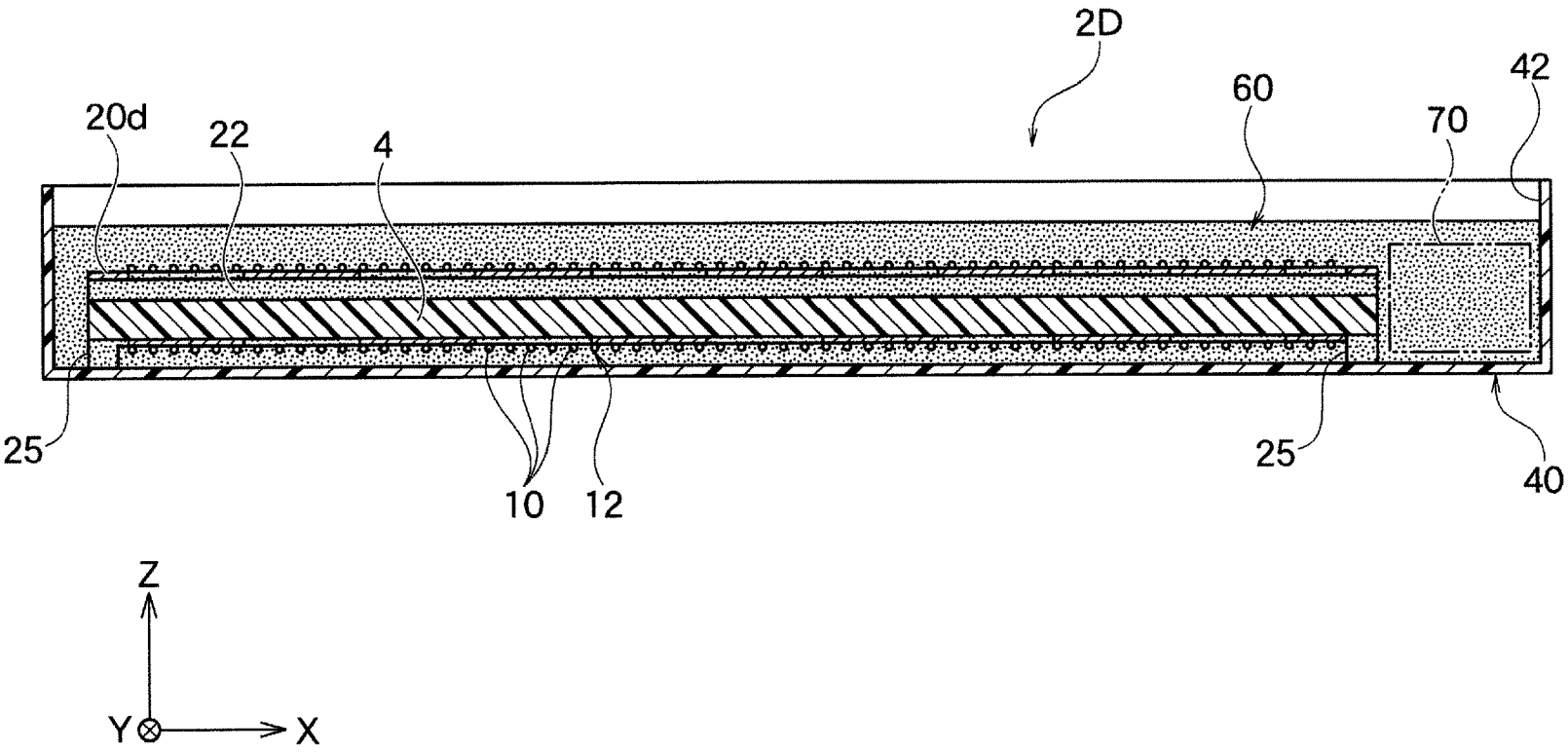
FIG. 2E is a cross sectional view of a coil device according to a comparative example.

The coil device 2 of the present embodiment shown in FIG. 1A to FIG. 2A is different from a coil device 2D of a comparative example shown in FIG. 2E. In the coil device 2D of the comparative example shown in FIG. 2E, legs (convex portions) 25 formed on a bottom surface of a bobbin 20*d* in the Z-axis direction are in contact with an inner bottom wall of the outer case 40 without inclination, a potting resin is filled in the housing concave portion 42 of the outer case 40. The legs 25 shown in FIG. 2E are a member that is not deformed more easily than the bobbin 20 or the outer case 40.

On the other hand, as shown in FIG. 1A to FIG. 2A, the bobbin 20 of the present embodiment touches the inner bottom wall of the outer case 40 inside the outer case 40 via the oblique plate legs 50 as easily deformable member. The oblique plate legs 50 are deformed before than deformations of the bobbin 20 and the outer case 40 when the outer case 40 receives an impact. That is, when the outer case 40 receives an impact, the oblique plate legs 50 are easily deformed elastically or plastically (may be broken), and the impact transmitted to the outer case 40 is weakened and transmitted to the bobbin 20. The potting resin 60 is filled in the space between the bobbin 20 and the outer case 40. The potting resin 60 has a sufficiently low longitudinal elasticity, and can thus effectively absorb the impact applied to the outer case 40 in cooperation with the oblique plate legs 50.

According to an experiment, it turned out that the coil device 2 of the present embodiment has an impact resistance improved three times or more than that of the coil device 2D of the comparative example shown in FIG. 2E. That is, it was confirmed that an impact applied to the core member 4 arranged inside the bobbin 20 (by a drop test) can be ⅓ or less of that of the comparative example. In the present embodiment, it is thus possible to effectively prevent a situation where the core member 4 is broken.

Since the oblique plate legs 50 are formed integrally with the bobbin 20 in the present embodiment, there is no need to separately prepare an easily deformable member, and this contributes to reduction of the number of components.

In the present embodiment, the opening portion 26 communicating inside and outside of the bobbin 20 is formed in the outer peripheral wall 24 constituting the hollow space 22. This enables the potting resin 60 to reach inside the bobbin 20, and it is thus possible to improve impact resistance characteristics and further effectively prevent the breakage of the core member 4 or so.

In the present embodiment, since the bobbin 20 is equipped with the pressing pieces 28, the core member 4 is positioned against the bobbin 20 with the coil portion 12, a positional displacement of the core member 4 against the coil portion 12 is prevented, and the characteristic deviation as antenna coil can be prevented.

Second Embodiment

Figure 3A:
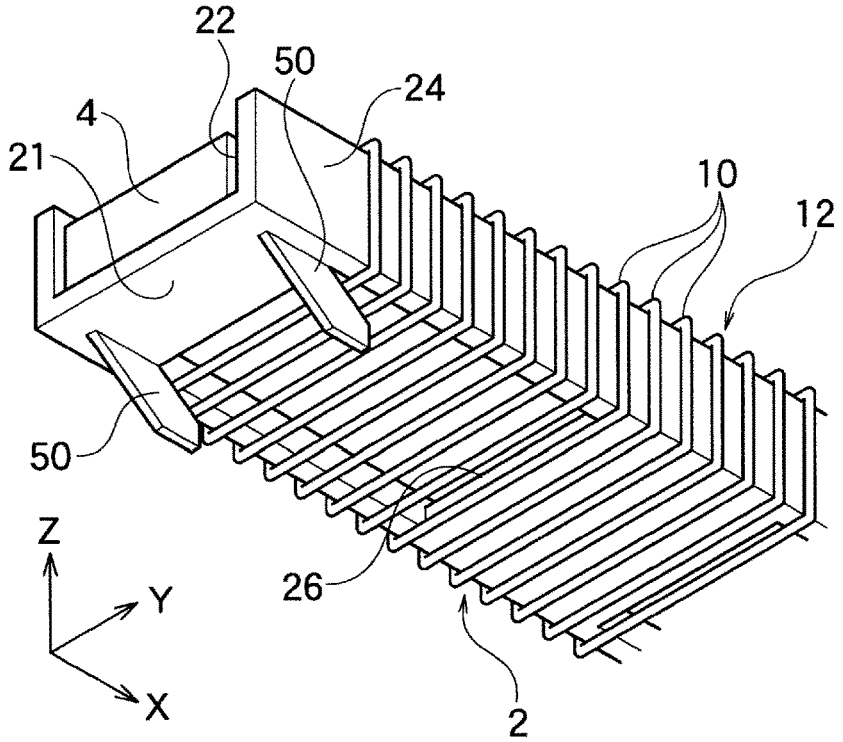
FIG. 3A is a partial perspective view of a bobbin of the coil device shown in FIG. 2A.
Figure 3B:
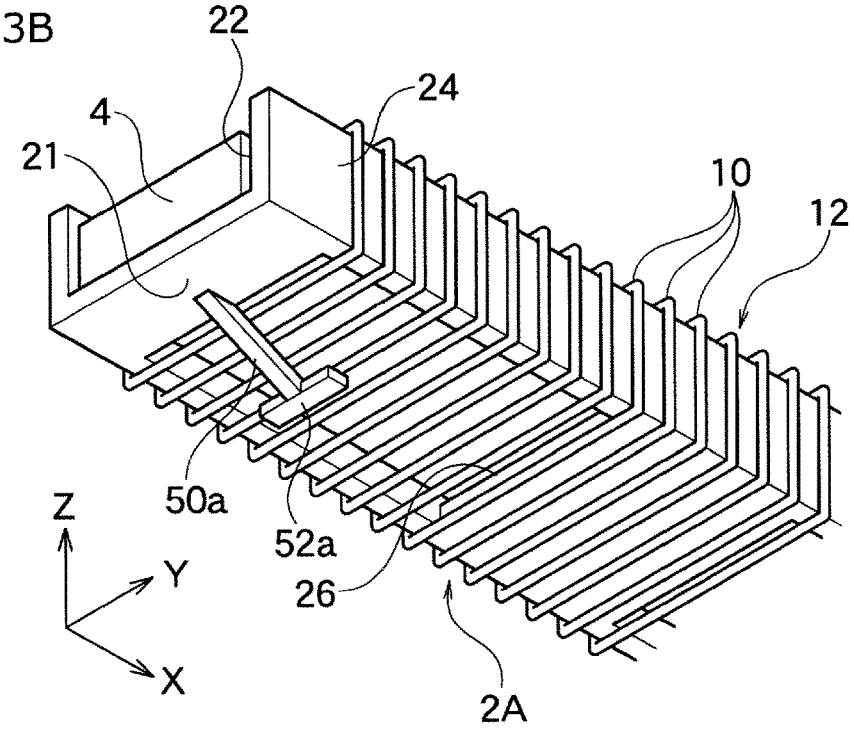
FIG. 3B is a partial perspective view of a bobbin of the coil device shown in FIG. 2B.

As shown in FIG. 2B and FIG. 3B, a coil device 2A of the present embodiment is different from the coil device 2 of First Embodiment only in the following matters, and overlapping matters will not be explained as the other features and effects are the same.

The present embodiment is the same as First Embodiment except that oblique linear legs 50*a* as easily deformable members are arranged on both ends of a bobbin 20*a* in the X-axis direction. A tip of the oblique linear leg 50*a* is provided with an abutting member 52*a* and is in surface contact with a bottom inner surface of the outer case 40. The oblique linear leg 50*a* can be deformed more easily than the oblique plate leg 50.

Third Embodiment

As shown in FIG. 2C, a coil device 2B of the present embodiment is different from the coil device 2 of First Embodiment only in the following matters, and overlapping matters will not be explained as the other features and effects are the same.

In the present embodiment, a bobbin 20*b* is provided with pressing pieces 28 (first pressing portions) protruding from a top surface in the Z-axis direction of the outer peripheral wall 24 constituting the bobbin 20*b* toward the hollow space 22, and is also provided with pressing pieces 28 (second pressing portions) protruding from a bottom surface in the Z-axis direction of the outer peripheral wall 24 toward the hollow space 22. In the present embodiment, the core member 4 is positioned in the hollow space 22 of the bobbin 20*b* by being sandwiched between the pressing members 28 located above and below in the Z-axis direction.

The embodiment shown in FIG. 2C has two pressing pieces 28 formed on the upper side of the bobbin 20*b* and three pressing pieces 28 formed on the lower side of the bobbin 20*b*, but any number of the pressing pieces 28 is employed as long as at least two pressing pieces 28 are formed on the upper side and one pressing piece 28 is formed on the lower side, or at least two pressing pieces 28 are formed on the lower side and one pressing piece 28 is formed on the upper side.

Even in this configuration, the core member 4 is positioned against the bobbin 20*b* with the coil portion 12, a positional displacement of the core member 4 against the coil portion 12 is prevented, and the characteristic deviation as antenna coil can be prevented. In addition, in this configuration, a space between the core member 4 and the bobbin 20*b* is formed on both sides of the core member 4 in the Z-axis direction, the potting resin 60 reaches the spaces, and impact resistance characteristics are further improved.

Fourth Embodiment

As shown in FIG. 2D, a coil device 2C of the present embodiment is different from the coil device 2A of Second Embodiment only in the following matters, and overlapping matters will not be explained as the other features and effects are the same.

The present embodiment is the same as Second Embodiment except that oblique linear legs 50*b* as easily deformable members are not formed on a bobbin 20*c* but are formed integrally on a bottom inner surface 41 of the outer case 40 with inclination of a predetermined angle θ. Tips of the oblique linear legs 50*b* are provided with abutting members 52*b* and are in surface contact with a bottom outer surface 21 of the bobbin 20.

Incidentally, the present invention is not limited to the above-mentioned embodiments, but may be variously changed within the scope of the present invention.

For example, the above-mentioned embodiments exemplify the pressing piece 28 of arc shape as the pressing portion, but the pressing portion formed on the bobbin is not limited to the pressing piece of arc shape. The pressing portion may have a shape other than the arc shape, and may have any shape with a structure where the core member 4 can be pressed from at least one of inner surfaces of the hollow space of the bobbin toward the separating direction by spring force.

The component case housed in the electronic component housing portion 70 may be formed integrally with the bobbin. The bottom part of the component case in the Z-axis direction may be provided with a leg in contact with the bottom inner surface of the outer case 40 (easily deformable member may be employed). The oblique plate leg 50 and the oblique linear legs 50*a* and 50*b* are not necessarily arranged near the component case housed in the electronic component housing portion 70. It is possible to have a space between the bottom surface of the bobbin 40 in the Z-axis direction and the bottom inner surface of the outer case 40 and reach a potting resin to the space only by forming the single oblique plate leg 50 or the single oblique linear leg 50 on the end portion of the bobbin 20 located opposite to the electronic component housing portion 70 along the X-axis direction.

In the present invention, the shape of the easily deformable member is not limited to the above-mentioned embodiments. For example, the pressing piece 28 of arc shape in the above-mentioned embodiments may be formed as easily deformable member on the bottom outer surface 21 of the bobbin 20 or the bottom inner surface 41 of the outer case 40. The easily deformable member is not necessarily formed integrally with the bobbin 20 or the outer case 40, and may be formed separately.

The above-mentioned embodiments have the easily deformable member constituted by using various measures for the shape of the plate piece or the linear piece (inclining, bending etc.), but a bobbin 20 or an outer case 40 having a small strength (buckling strength, bending strength, compressive strength etc.) may be employed as easily deformable member.

NUMERICAL REFERENCES

2, 2A to 2D . . . coil device
4 . . . core member
10 . . . wire
12 . . . coil portion
20 to 20*c*, 20*d* . . . bobbin
21 . . . bottom outer surface
22 . . . hollow space
24 . . . outer peripheral wall
25 . . . leg
26 . . . opening portion
28 . . . pressing piece (pressing portion)
40 . . . outer case
41 . . . bottom inner surface
42 . . . housing concave portion
50 . . . oblique plate leg (easily deformable member)
50*a* . . . oblique linear leg (easily deformable member)
52*a* . . . abutting member

60 . . . potting resin

70 . . . electronic component housing portion

The invention claimed is:

1. A coil device comprising:

a core member extending in a longitudinal direction;

a bobbin with a hollow space housing the core member;

a coil portion with a wire wound around an outer peripheral wall of the bobbin;

an outer case configured to house the bobbin, the core member and the coil portion;

a potting resin filled in the outer case and surrounding the bobbin and the coil portion; and an easily deformable member (1) arranged between the outer peripheral wall of the bobbin and a wall of the outer case to maintain the bobbin in spaced relationship to the outer case such that there is a space between the outer peripheral wall of the bobbin and the wall of the outer case and (2) capable of being deformed before deformations of the bobbin and the outer case when the outer case receives an impact; wherein:

the easily deformable member is an oblique plate leg, the outer peripheral wall has an opening beneath the coil portion, the bobbin includes a pressing portion protruding from an inner surface of the outer peripheral wall into the hollow space, the pressing portion (a) is formed integrally with the outer peripheral wall and (b) is located in the opening, and the potting resin is filled (1) around a periphery of the bobbin and the coil portion, (2) in a space between the bobbin and the core member, and (3) in the space between the outer peripheral wall of the bobbin and the wall of the outer case.

2. The coil device according to claim 1, wherein the pressing portion presses the core member against an inner surface of the outer peripheral wall.

3. The coil device according to claim 1, wherein the pressing portion is a first pressing portion protruding from a first inner surface of the outer peripheral wall;

the bobbin includes a second pressing portion protruding from a second inner surface of the outer peripheral wall toward the hollow space, and the first inner surface and the second inner surface oppose each other such that the first pressing portion and the second pressing portion sandwich the core member so that the core member is positioned in the hollow space of the bobbin.

4. The coil device according to claim 1, wherein the easily deformable member is formed integrally with the outer case.

5. The coil device according to claim 4, wherein the pressing portion presses the core member against an inner surface of the outer peripheral wall.

6. The coil device according to claim 4, wherein the pressing portion is a first pressing portion protruding from a first inner surface of the outer peripheral wall;

the bobbin includes a second pressing portion protruding from a second inner surface of the outer peripheral wall toward the hollow space, and the first inner surface and the second inner surface oppose each other such that the first pressing portion and the second pressing portion sandwich the core member so that the core member is positioned in the hollow space of the bobbin.

7. The coil device according to claim 1 used as an antenna coil mounted inside a doorknob.

8. The coil device according to claim 7, wherein the core member has a flat tabular shape that is thin in a predetermined axis direction.

9. The coil device according to claim 1, wherein the easily deformable member is formed integrally with the bobbin.

10. The coil device according to claim 9, wherein the pressing portion is a first pressing portion protruding from a first inner surface of the outer peripheral wall;

the bobbin includes a second pressing portion protruding from a second inner surface of the outer peripheral wall toward the hollow space, and the first inner surface and the second inner surface oppose each other such that the first pressing portion and the second pressing portion sandwich the core member so that the core member is positioned in the hollow space of the bobbin.

11. The coil device according to claim 9, wherein the pressing portion presses the core member against an inner surface of the outer peripheral wall.

12. The coil device according to claim 9, wherein the easily deformable member is formed integrally with the outer case.

13. The coil device according to claim 12, wherein the pressing portion presses the core member against an inner surface of the outer peripheral wall.

14. The coil device according to claim 12, wherein the pressing portion is a first pressing portion protruding from a first inner surface of the outer peripheral wall;

the bobbin includes a second pressing portion protruding from a second inner surface of the outer peripheral wall toward the hollow space, and the first inner surface and the second inner surface oppose each other such that the first pressing portion and the second pressing portion sandwich the core member so that the core member is positioned in the hollow space of the bobbin.

* * * * *